United States Patent [19]

Greenleaf

[11] 4,453,280

[45] Jun. 12, 1984

[54] PORTABLE SHOWER

[76] Inventor: John P. Greenleaf, 1421 E. Flower, Phoenix, Ariz. 85014

[21] Appl. No.: 460,254

[22] Filed: Jan. 24, 1983

[51] Int. Cl.[3] ..... A47K 3/23

[52] U.S. Cl. ..... 4/599; 4/603; 4/616

[58] Field of Search ..... 4/599, 600, 614, 596–598, 4/601–613, 615, 616

[56] References Cited

U.S. PATENT DOCUMENTS 3,067,434 12/1962 Neal et al. ..... 4/599
3,629,875 12/1971 Dow ..... 4/599
3,646,618 10/1970 Johnson ..... 4/599

*Primary Examiner*—Stephen Marcus
*Assistant Examiner*—Kenneth S. Putnam
*Attorney, Agent, or Firm*—Drummond & Nissle

[57] ABSTRACT

A self-contained portable shower which can be readily disassembled and conveniently stored in a compact carrying case.

5 Claims, 4 Drawing Figures

PORTABLE SHOWER

This invention pertains to shower apparatus.

More particularly, the invention relates to portable shower apparatus including a supply of water and conduit for dispensing the water through a shower head, the portable shower being operative without having to position the water supply so that the force of gravity causes water to flow through the conduit and shower head and against an individual standing beneath the shower head.

In a further respect, the invention pertains to a self-contained portable shower including a plurality of components which can be readily and conveniently assembled by persons of limited mechanical skill without the use of tools.

In another respect, the invention relates to a self-contained portable shower which can be disassembled such that all components of the shower can be stored and transported in a compact carrying case.

In still another respect, the invention pertains to a portable shower which includes means for shielding an individual utilizing the shower from the view of others and which provides secure footing to minimize the likelihood of the individual slipping and falling while in the shower.

In yet another respect, the invention pertains to a portable shower specially adapted for use in a confined area having a relatively level area of ground.

Portable shower apparatus is widely known in the art. See, for example, U.S. Pat. Nos. 4,151,616 to Larsen, 4,280,643 to Cordove et al, 1,398,208 to Trial, 4,294,409 to Larsen, and 930,093 to Schmitt. The Portable shower apparatus disclosed in these patents has certain limitations. Each of the portable showers utilizes the force of gravity to cause water to flow from a container through a shower head; consequently, during use of these portable shower units, the water container must be maintained in a position above the individual taking a shower. The water containers utilized in prior art portable shower units are equipped with a strap or other means for securing the container to a tree or other support. Although in many instances there is an object on which the water container may be hung, some areas are devoid of convenient supports on which to secure a water container, and gravity flow portable shower apparatus can only be used if another person holds the water container for the individual taking the shower. Such a procedure is often, for reasons of privacy, not satisfactory. Another drawback of prior art gravity flow shower apparatus is that when the apparatus is utilized out-of-doors, water from the apparatus wets the ground on which the individual stands while taking a shower, increasing the likelihood that the individual may slip, fall and injure himself. A further limitation of prior art portable showers is that they generally fail to provide a curtain or other means to shield an individual from onlookers while he is utilizing the shower.

Accordingly, it would be highly desirable to provide an improved portable shower which would not utilize the force of gravity to cause water to flow from a reservoir and through a shower head and which would provide means for shielding an individual utilizing the shower from the view of others.

It would also be highly desirable to provide an improved portable shower which would reduce the likelihood of an individual slipping and falling while utilizing the shower.

Further, it would also be highly desirable to provide a self-contained portable shower which could be readily disassembled and stored and transported in a compact carrying case.

Therefore, it is a principal object of the invention to provide an improved portable shower.

A further object of the instant invention is to provide an improved portable shower which does not, during operation of the shower, require the force of gravity to cause water to flow from a reservoir through a shower head and against an individual using the shower.

Another object of the invention is to provide a portable shower which provides means for shielding an individual from view and for preventing the individual's feet from slipping on the ground during utilization of the shower.

Still a further object of the invention is to provide an improved portable shower of the type described which is self-contained and can be readily disassembled and stored in compact carrying case.

Yet another object of the present invention is to provide an improved self-contained portable shower which includes means for heating water stored in the portable shower apparatus.

These and other, further and more specific objects and advantages of the invention will be apparent to those skilled in the art from the following detailed description thereof, taken in conjunction with the drawings, in which.

Figure 1:
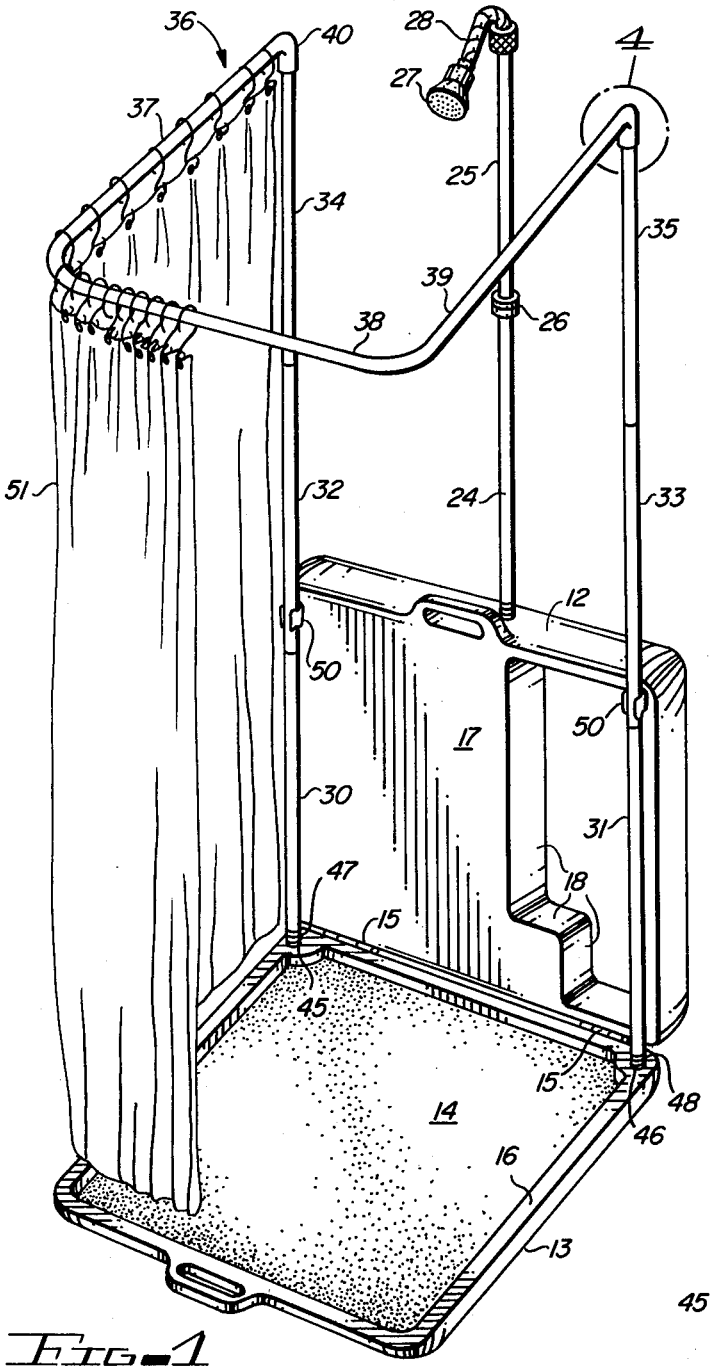
FIG. 1 is a perspective view of portable shower apparatus constructed in accordance with the principles of the invention.
Figure 2:
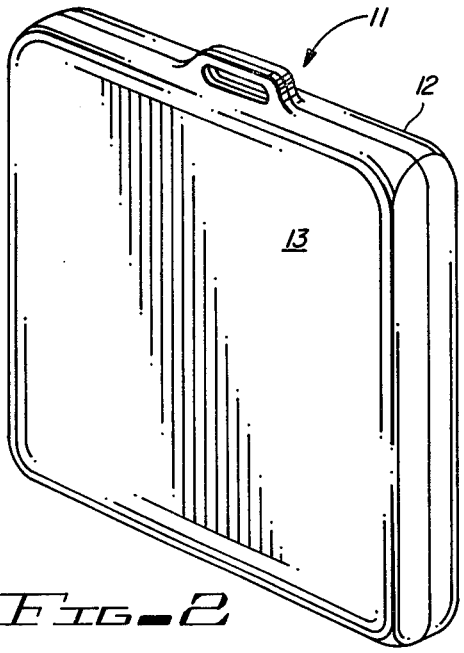
FIG. 2 is a perspective view of the carrying case of the portable shower apparatus of FIG. 1 after the apparatus has been disassembled and stored in the carrying case and the case has been closed.
Figure 3:
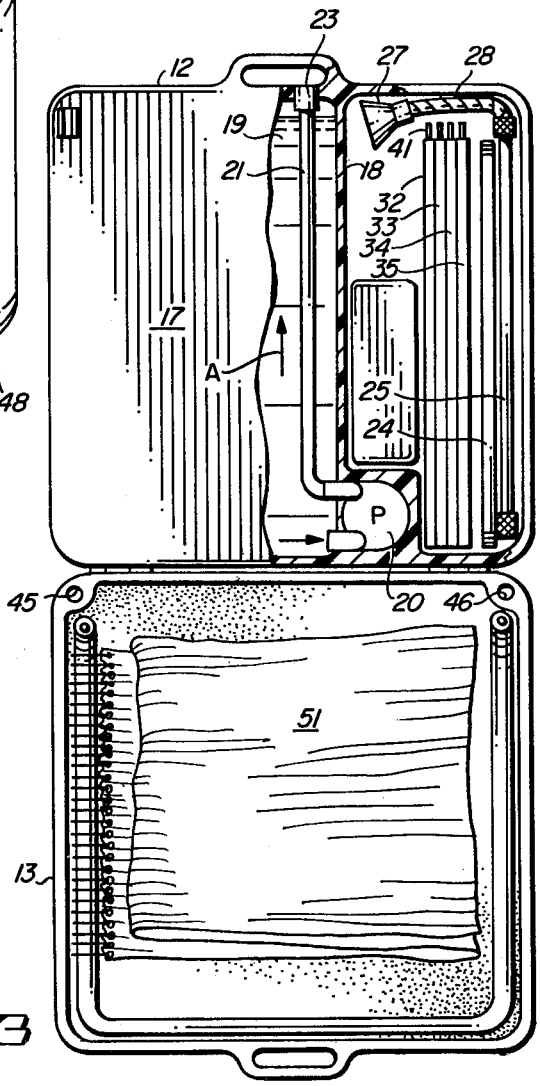
Figure 4:
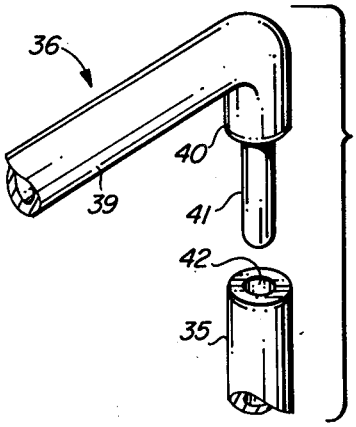

FIG. 3 is a top view of the carrying case of FIG. 2 opened to illustrate the packing of disassembled components of the apparatus of FIG. 1 in the carrying case, a portion of the carrying case being partially broken away to further illustrate the interior construction thereof; and FIG. 4 is a perspective view of a portion of the shower curtain support frame of the apparatus of FIG. 1 as indicated therein by dashed circle 4.

Briefly, in accordance with my invention, I provide an improved portable shower for use in a confined area. The shower includes a frame; a water container carried in the frame; a shower head; conduit means interconnecting the water container and shower head; a pump in fluid communication with the container for directing water stored in the container through the conduit means and the shower head; and support means for carrying a shower curtain, the support means being attached to the frame and including a plurality of elongate interconnected members. The frame of the portable shower is normally set on a support surface during utilization of the apparatus to take a shower.

Turning now to the drawings, which depict the presently preferred embodiment of the invention for the purpose of illustrating the practice of thereof and not by way of limitation of the scope of the invention and in which like reference characters refer to corresponding elements throughout the several views, FIGS. 1 to 4 illustrate the presently preferred embodiment of the invention including a carrying case frame 11 having a top half 12 and bottom half 13 interconnected by hinges 14. The inner face of bottom half 13 is provided with a layer of non-skid material 14. Surface 14 is recessed in bottom half 13 of carrying case 11 such that continuous lip 16 retains water within lower half 13 above surface 14. A water container 17 is integrated with and carried by the top half 12 of case 11. Container 17 includes wall 18 traversing upper half 12. As shown in FIG. 3, water 19 stored in container 17 is drawn through pump 20 and directed upwardly through conduit 21 in the direction of arrow A. Pump 20 may be driven by a battery power pack 22, be provided with an electrical extension cord (not shown), or be driven with a gasoline powered or other type of auxiliary motor (not shown).

In FIG. 1, the lower end of conduit 24 threads into hollow internally threaded cylindrical receptacle 23. The threaded upper end of cylindrical conduit 24 turns into the internally threaded receptacle 26 at the lower end of conduit 25. Shower head 27 with flexible neck 28 is detachably fixedly secured to the upper end of conduit 25. The shower curatin support frame includes interconnected rod members 30–35, 37–39. Member 37–39 are permanently interconnected to form U-shaped, generally horizontally oriented, member 36. Members 37, 39 are each provided with a downturned foot 40 having pin 41 downwardly projecting therefrom (FIG. 4). Pins 41 are slidably received in circular apertures 42 formed in rods 34, 35. As shown in FIG. 3, the lower ends of members 34, 35 are also provided with pins 41 which are received by apertures 42 (not shown) formed in the upper ends of rods 32, 33. The lower ends of members 32, 33 are similarly provided with downwardly projecting pins 41 received by cylindrical apertures 42 formed in the upper ends of members 30, 31. Lower threaded ends 47, 48 of rods members 30, 31 are rotatably received by internally threaded apertures 45, 46 formed in bottom half 13 of case 11. Clips 50 are permanently secured to upper half 12 of case 11. Rods 32, 33 are, as illustrated in FIG. 1, snapped into clips 50 to provide additional support for the shower curtain frame. In FIG. 3, conduit members 30, 31 have, for the sake of clarity, not been shown inside the generally L-shaped storage compartment of upper half 12 of case 11. Before case 11 is closed to the storage configuration shown in FIG. 2, conduit members 30, 31 are placed in upper half 12 on top of members 32–35.

In FIG. 3, U-shaped member 36 is stored inside the recessed area of lower half 13 of case 11. Shower curtain 51 slidably carried on member 36 is folded and also stored in lower half 13 of carrying case 11.

In use, a relatively level floor or ground area is located, carrying case 11 of FIG. 2 opened, and the conduit and rod members stored in upper half 12 are removed. Lower ends 47, 48 of rods 30, 31 are threaded into apertures 45, 46 of lower half 13 of case 11. Pins 41 on the lower ends of member 32, 33 are inserted in cylindrical apertures 42 formed in the upper ends of members 30, 31 and members 32, 33 are forced into snaps 50 in upper half 12 of case 11 so that case 11 is secured in the generally L-shaped position depicted in FIG. 1. Rods 34, 35 and 36 are then installed in the positions shown in FIG. 1. After the lower end of conduit 24 is threaded into receptacle 23 and the lower end of conduit 25 threaded into receptacle 26 of conduit 24, an individual can step onto non-skid surface 14, pull shower curtain 51 around U-shaped members 36 and activate pump 20.

As would be appreciated by those of skill in the art, conduit members 25, 24 can be replaced by a length of flexible conduit so an individual utilizing the shower could hold and move shower head 27 in one of his hands to direct water from shower head 27 over various areas of his body. A T-fitting could be incorporated in conduit 24 or 21 so that both the fixed shower head of FIG. 1 and a hand held shower head could be simultaneously utilized.

If desired, pump 20, water contianer 17, non-skid material 14, conduits 24, 25, shower head 27 and rods 30–35, 37–39, could be constructed and stored in case 12 such that each or all of these elements could be entirely removed from the case to a location separate from the case and assembled so an individual could utilize these components to take a shower.

Case 12 could be provided with means for heating water stored in container 17. The back side upper half 12 of container 11 (not visible in FIGS. 1 and 2) could be constructed from black material which would absorb sunlight and, by conducting energy through the material, heat water 23 in container 17. Or, a battery powered electrical resistance coil could be inserted in container 17 to heat water 23. The coil could be connected to power pack 22 or to an extension cord.

A small solar energy panel could be included with and stored inside case 12 with the other components shown in FIG. 3. Container 17 could be adapted so water could be drawn therefrom to the solar energy panel and returned to container 17 after being heated by the solar panel.

Although not visible in the drawings, container 17 is provided with an opening through which water can be directed into container 17. The opening is sealed with a detachable cap.

As earlier noted, any or all of the components of the portable shower of the invention do not have to be integrated with carrying case 11 and can, if desired, be designed to be completely removed and separated from case 11 in order to construct a shower in accordance with the principles of the invention. In addition, an auxiliary water container could be supplied with or separately from case 11. If the auxiliary water container were constructed from a flexible plastic which could be collapsed and folded when empty, the container could be stored in case 11. The auxiliary water container would, as necessary, be adapted for use with other components of the portable shower. Pump 20 could be designed to be foot or manually powered so that a source of electricity would be required to operate the shower. Non-skid surface 14 can be comprised of any material which tends to minimize the slipping of an individual's foot across surface 14 when surface 14 is wet.

Having described my invention in such terms as to enable those skilled in the art to understand and practice it, and having identified the presently preferred embodiments and best mode thereof, I claim:

1. A portable shower container having a disassembled configuration in which said container is closed with shower components stored therein, and an assembled configuration utilized by an individual for showering, said portable shower container including (a) a generally rectangular first section generally horizontally disposed when said shower container is in said assembled configuration;

(b) a generally rectangular second section pivotally attached to said first section and vertically disposed generally at a right angle with respect to said first section when said shower is in said assembled configuration;

(c) a support frame including a plurality of interconnected elongate members for carrying a shower curtain, said frame being fixedly, detachably secured to said first and second sections when said shower container is in said assembled configuration such that said first section is maintained in said right angle relationship with respect to said second section;

(d) a generally enclosed water container carried in said second section;

(e) conduit means interconnecting said water container and said shower head; and, (f) a pump in fluid communication with said container for directing water stored in said container through said conduit means and said shower head;

said support frame members, said shower head and at least a portion of said conduit means being stored and carried in said portable shower container when said shower container is in said disassembled configuration, said first section including at least one aperture adapted to fixedly, detachably receive an end of one of said elongate members of said support frame when said shower container is in said assembled configuration, said one of said elongate members being generally vertically oriented, and said second section including clip means for detachably securing at least one of said elongate members of said support frame in position adjacent said second section, said one of said elongate members secured by said clip means being generally vertically oriented.

2. The portable shower container of claim 1 wherein said second section includes outer peripheral walls and said water container is integrally formed in said second section such that at least a portion of the walls of said water container correspond to and are formed by said outer peripheral walls of said second section.

3. The portable shower container of claim 2 wherein said pump is fixedly integrated in said second section of said shower container.

4. The portable shower container of claim 3 wherein said walls of said water container are comprised of material which absorbs solar energy and transmits heat to water stored in said water container.

5. The portable shower container of claim 4 wherein said vertically oriented elongate member with said end fixedly received by said aperture in said first section and said vertically oriented elongate member secured to said second section by said clip means are components in a vertically oriented structural member connected to and supporting a horizontally oreinted shower curtain rod, said structural member and curtain rod comprising at least a portion of said support frame.

* * * * *